US006607472B2

(12) United States Patent
Toole

(10) Patent No.: US 6,607,472 B2
(45) Date of Patent: Aug. 19, 2003

(54) BODY CONDITIONING EXERCISE MACHINE

(76) Inventor: Robert Madison Toole, P.O. Box 1024, Corona, CA (US) 92878

( * ) Notice: Subject to any disclaimer, the term of this patent is extended or adjusted under 35 U.S.C. 154(b) by 136 days.

(21) Appl. No.: 09/954,325

(22) Filed: Sep. 17, 2001

(65) Prior Publication Data

US 2003/0054926 A1 Mar. 20, 2003

(51) Int. Cl.[7] ..... A63B 21/02

(52) U.S. Cl. ..... 482/123; 482/907; 482/96; 482/121

(58) Field of Search ..... 482/123, 907, 482/121, 132, 72, 71, 95, 142, 129–136, 904

(56) References Cited

U.S. PATENT DOCUMENTS 5,433,685 A * 7/1995 Winslow et al. ..... 482/96
D362,700 S * 9/1995 Breibart et al. ..... D21/195
6,110,081 A * 8/2000 Barrett ..... 482/123
6,186,929 B1 * 2/2001 Endelman et al. ..... 482/121

* cited by examiner

*Primary Examiner*—Jerome W. Donnelly

(57) ABSTRACT

An exercise machine for conditioning muscles of the lower body, abdomen and torso utilizes dual elastic cord resistance to force exerted on a moving platform which rides on rollers set in tracks on the frame. When used suspended with adjustable straps from door hook attachment, user leans back against vertical moving padded platform and exerts downward pressure in a deep knee bend motion and up again. When used horizontally on the floor user mounts machine on all fours with shins on platform and arms extended towards opposite end of machine with hands around grips of adjustable bar assembly. Movement is gained by extending and contracting lower body while moving platform back and forth. Also, user may kneel on a pad which may be located just beyond and facing the machine. With hands securely gripping platform handles user may exert force and move platform to other end of machine by extending torso over said machine.

1 Claim, 6 Drawing Sheets

BODY CONDITIONING EXERCISE MACHINE

FIELD OF INVENTION

This invention is unique and useful for conditioning muscles of the legs, hips, derriere, torso and abdomen without requiring excessive strain while utilizing a compact, light weight and adjustable device. As muscles develop and strengthen over time the elastic cords can be disengaged to facilitate further condition.

BACKGROUND OF THE INVENTION

Weight displacement devices for deep knee bend movements and machines employed for abdomen and torso conditioning are known. Athletic clubs and health fitness centers abound with similar equipment. Unfortunately most have bulky size, heavy weight, are very complex and lack portability.

One object of the present invention is to overcome these disadvantages by providing a body conditioning exercise machine which is compact in size, light weight, user friendly, portable and relatively inexpensive to manufacture.

SUMMARY OF THE INVENTION

In accordance with the present invention a unique and useful exercise machine will become readily apparent from a study of the following description and accompanying drawings:

The exercise machine utilizes a sliding padded platform which moves back and forth on a frame against dual elastic cord resistance and may be suspended from a door, using hook attachment and adjustable straps or used horizontally on the floor.

The frame includes a pair of vertical cylindrical posts the top surface of each which serve as a sliding guide for the platform via plastic rollers.

Centered on the machine between the posts is a formed track which provides a smooth riding surface for two sets of nylon rollers which mount to the carriage base.

The alignment of the top surface plastic rollers with the track encased nylon rollers creates a free floating carriage which may move unobstructed from top to bottom.

Occupying the hollow space of each cylindrical end frame are elastic cords which may extend full length and terminate at the carriage return position. Two pulleys threaded with said elastic cords continue the connection to nearly the end of each post. Projecting out from each pulley assembly are steel clips which may be attached to the floating carriage.

The padded platform is secured to the top or working side of the carriage.

With the machine in a vertically suspended position the user may lean back against the padded platform and may lower to a deep knee bend position while the elastic cords stretch and resistance to the movement increases. On return to erect position the elastic cords may act as a counter force to assist users upward movement.

It is therefore an object of the present invention to provide an exercise machine using a smooth sliding platform moveable against a resistance force of dual elastic cords.

Another objective of the present invention is to provide an exercise machine which is adjustable to persons of different height and physical development.

Yet another objective of the present invention is to provide an exercise machine which is portable and easy to use.

A further object of the present invention is to provide an exercise machine with sliding platform which may be placed on the floor in a horizontal position and utilized in a manner that may increase to three the number of lower body conditioning exercises a user may perform.

These and other objects and advantages will become apparent from a study of the following drawings of detailed embodiments.

DESCRIPTION OF THE PREFERRED EMBODIMENTS

The following detailed description of the preferred embodiments may yield a better understanding of various aspects of the present invention as referred to in the above described drawings.

Figure 1:
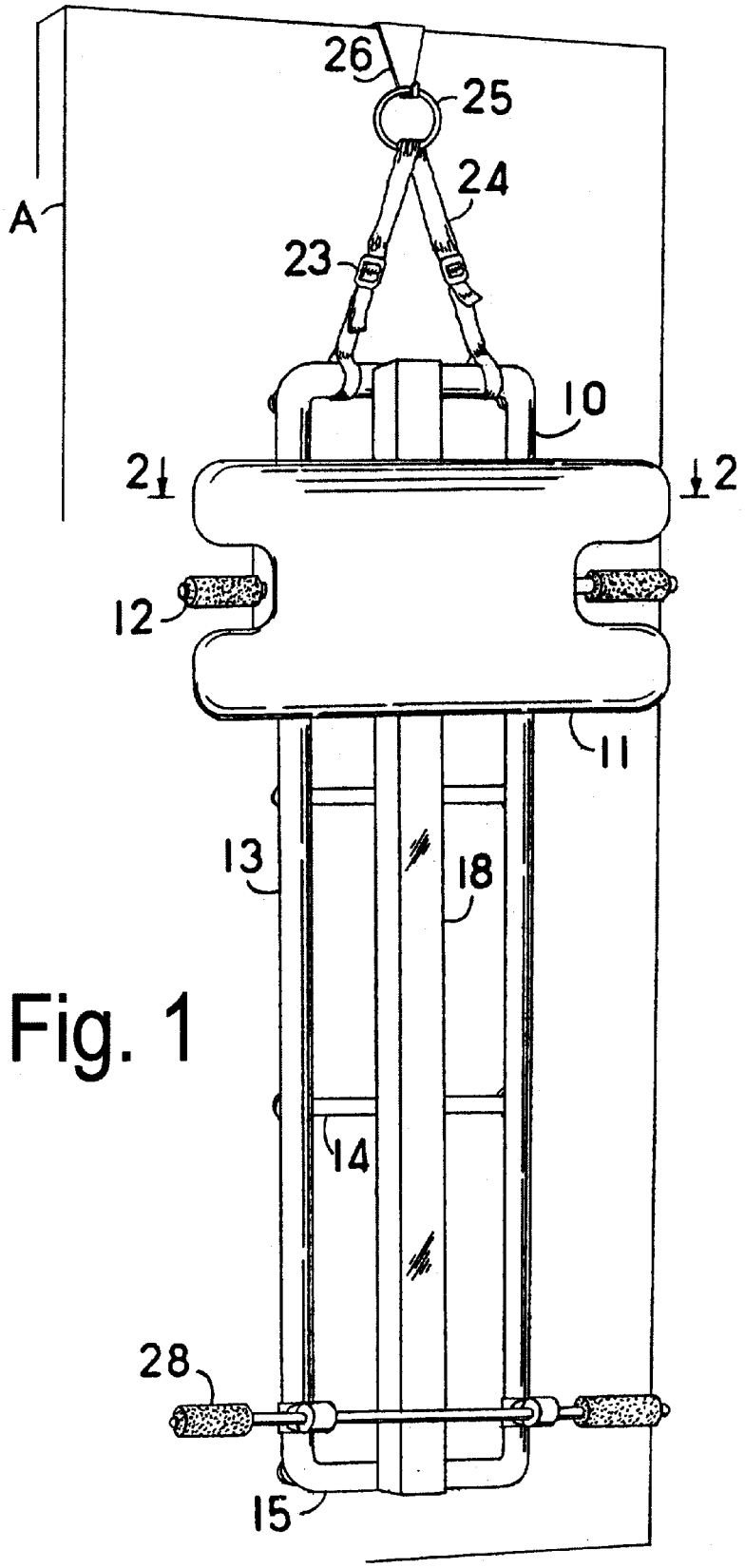
FIG. 1 is a perspective view of an exercise machine embodying the principles of the present invention.

The exercise machine of the present invention reference character 10, FIG. 1, as depicted in the hanging position from a door A, utilizes a padded platform 11, with handgrip bar 12, which is intended to support the lean-to lateral force or body weight of the user. Platform 11 may slide on the center track 18 and glide along round tubular end frames 13 which are separated by a fixed distance with two perpendicular braces 14 at third points. The center track is supported by and securely attached at each end to connecting frame members 15 running across the top and bottom spanning and bonded to end frames. Also shown in FIG. 1 are the adjustable buckles 23 and straps 24 which may facilitate suspending the machine in a vertical position by employing hanging ring 25 and door hook attachment 26.

Figure 2:
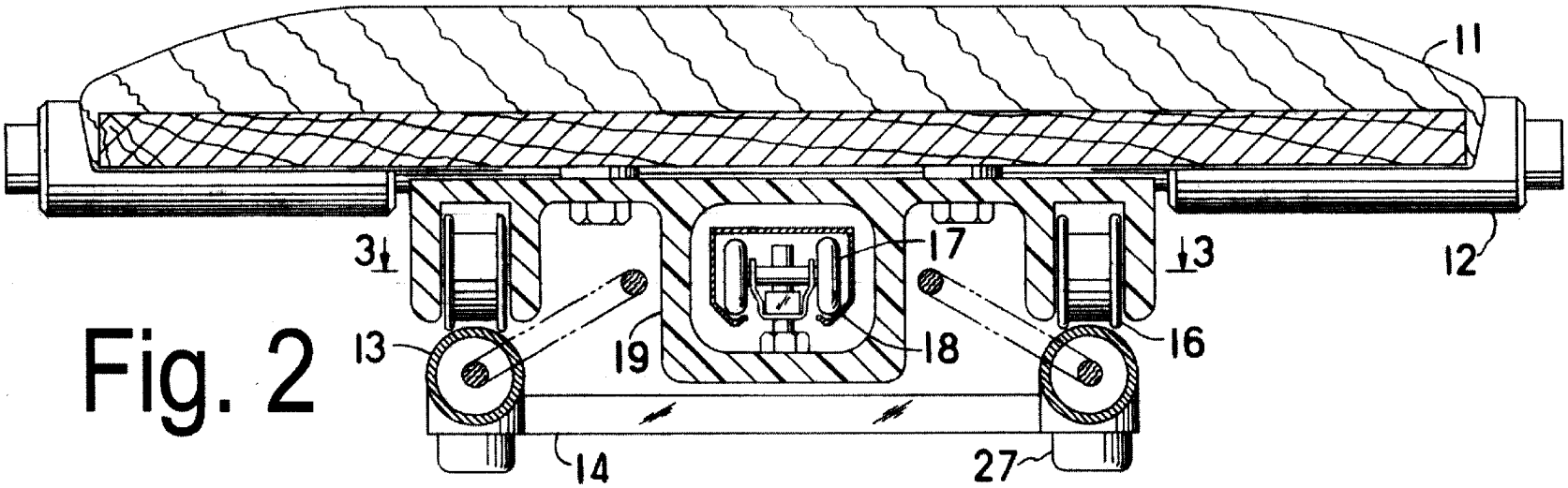
FIG. 2 is a cross section view taken along line 2—2 of FIG. 1.

Four plastic rollers 16, attached to bottom of moveable platform 11 and two sets of four wheel nylon trolleys 17 may allow user force and weight to be transferred to side frames 13 and center track 18 via the connecting carriage assembly 19 as shown in FIG. 2. Precise alignment of said elements may provide for a completely free floating carriage and platform.

Figure 3:
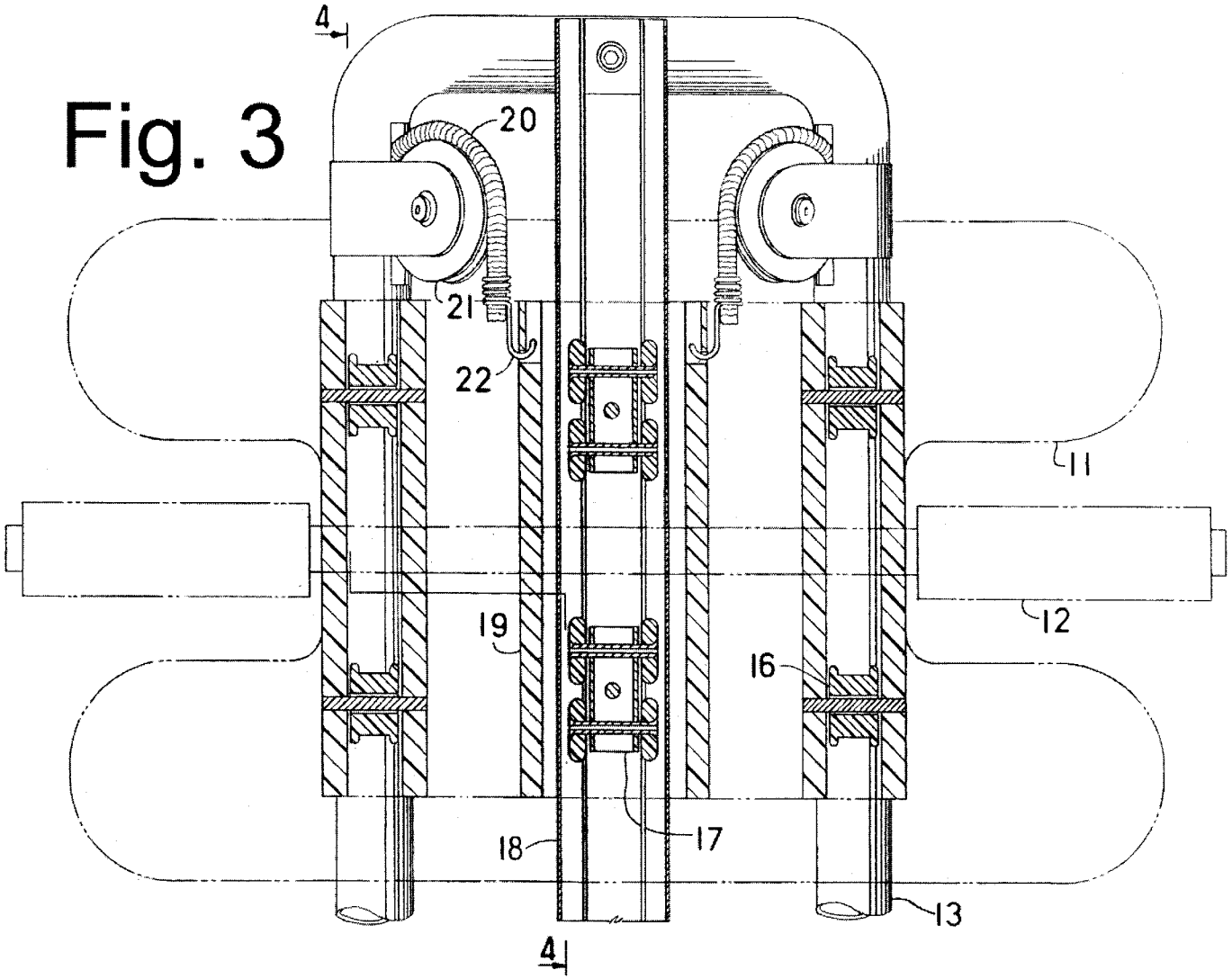
FIG. 3 is a cross section view taken along line 3—3 of FIG. 2.

Resistance to force applied to the moveable carriage may be provided by two elastic cords 20 securely connected with steel clips 22 to the carriage assembly 19 as FIG. 3 reveals. Enough tension is present to keep the carriage in a returned position at top of machine frame when viewed in the suspended position. Secured at the bottom of tube frame 13 said cords extend full length through the hollow space in frames and terminate at the yoke and pulley fixtures 21. A change of direction is made when the elastic cords thread through said pulleys to continue on and connect to the side of the carriage assembly.

Figure 4:
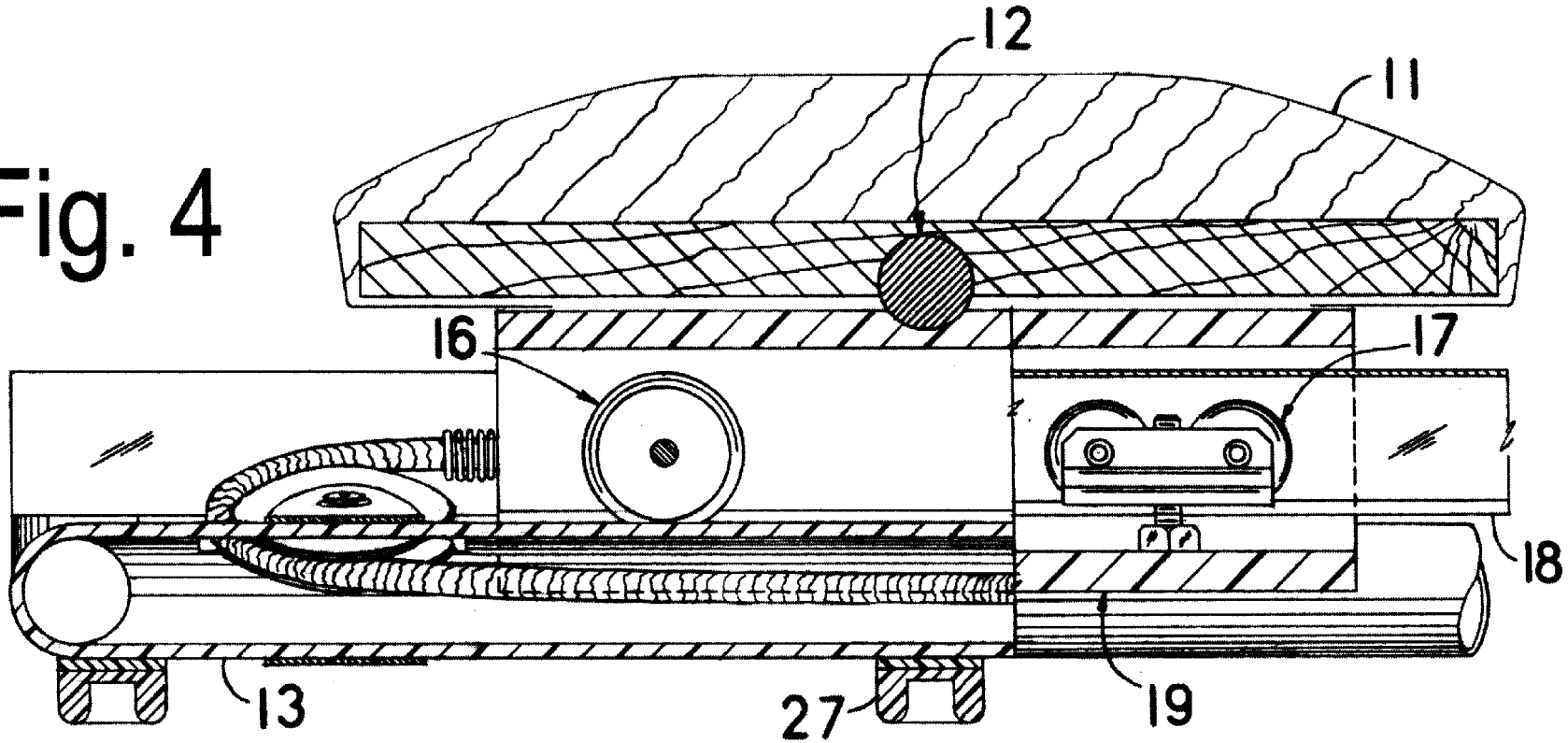
FIG. 4 is a staggered cross section view taken along line 4—4 of FIG. 3.

In FIG. 4 the padded platform 11 may be secured to the face or working side of the carriage 19 and may move on rollers 16 which may glide along tubular end frames 13 and may also roll on four wheel trolleys 17 enclosed in full length track 18. Frame 13 may be supported above door or floor surface by legs 27.

Figure 4A:
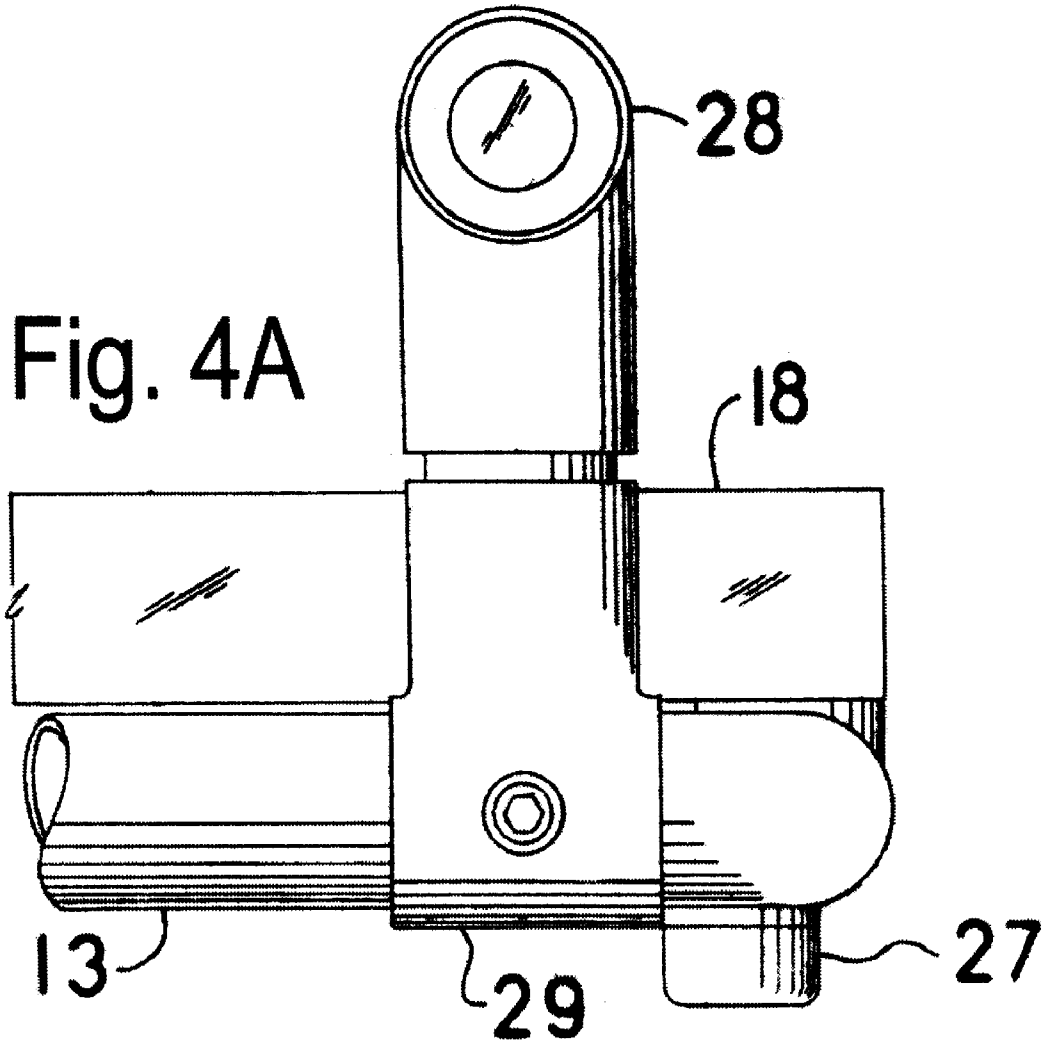
FIG. 4A is a side view of lower hand grip assembly.

Depicted in FIG. 4A are adjustable clips 29 which wrap each end frame 13 and may position hand grips 28 to the same distance away from tubular frame 13 as is the moving platform surface and may also be adjusted to users physical stature by moving said hand grip bar assembly back or forth on tubular end frames to find an appropriate location to be secured or kept at the fully extended position shown.

Figure 5A:
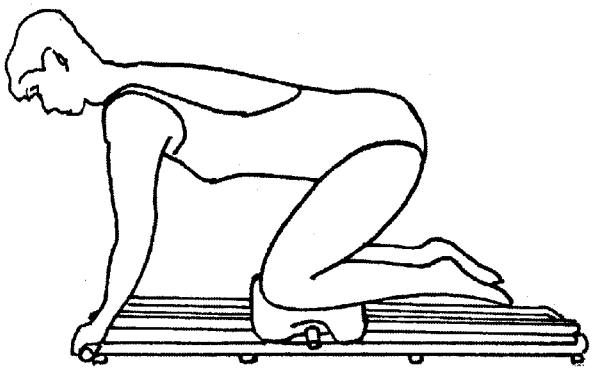
FIG. 5, FIG. 5A and FIG. 5B provides perspective views of three possible exercise movements available to the user.
Figure 5:
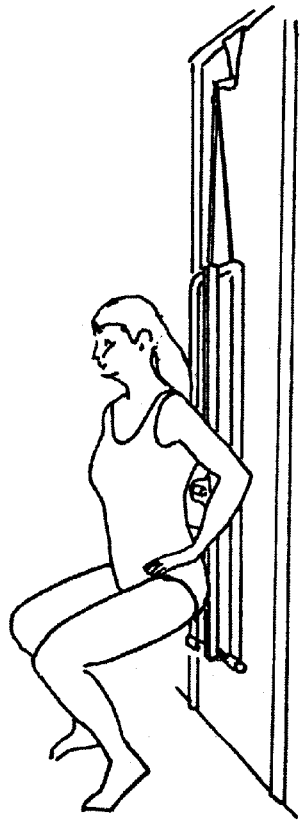

FIG. 5 shows vertical set-up with user leaning back against platform and lowering to deep knee bend then back up to legs straight position.

FIG. 5A illustrates the use of the exercise machine for performing a shin movement. With body weight balanced on hands and shins, movement is accomplished by moving platform back and forth traversing virtually the machines full length.

Figure 5B:
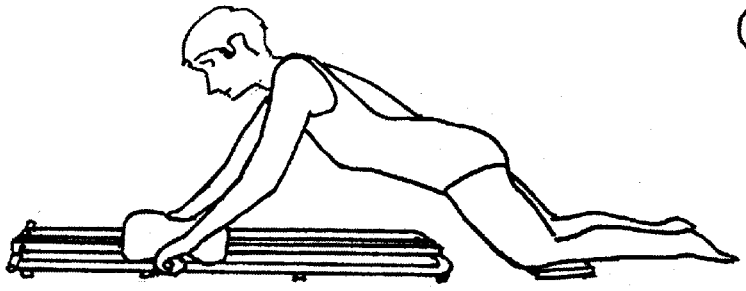

Movement in FIG. 5B is the same as FIG. 5A except that body weight is balanced on a knee pad and the moving platform. User extends torso over length of machine and returns to start position.

What I claim as my invention is:

1. A body conditioning exercise machine comprising:

A track attached centrally to a top and to a bottom horizontal support, said support each being connected to a pair of hollow outer frame members and;

A movable carriage having rollers adapted to ride, the full length of the machine, on said rollers which are positioned within said track, said moveable carriage additionally including a plurality of rollers, which glide along a surface of the hollow frame members;

Said carriage motion being resisted by a pair of elastic cords routed within the length of hollow space in the frame members and, are connected by clips to the moveable carriage;

A platform connected to said moveable carriage for supporting a user; said

A door hook with adjustable straps attached t the door machine which allows the machine to be suspended above the floor at a appropriate height for the user; and said machine may also be fully user functional when located in a horizontal position o the floor.

* * * * *